US011165201B2

(12) United States Patent
Hsiao et al.

(10) Patent No.: US 11,165,201 B2
(45) Date of Patent: Nov. 2, 2021

(54) OBLIQUE-INSERT-PROOF STRUCTURE AND INTERFACE CARD COMPRISING THE SAME

(71) Applicant: BIZLINK INTERNATIONAL CORPORATION, New Taipei (TW)

(72) Inventors: Hsin Tuan Hsiao, New Taipei (TW); Jui Hung Chien, New Taipei (TW)

(73) Assignee: Bizlink International Corporation, New Taipei (TW)

( * ) Notice: Subject to any disclaimer, the term of this patent is extended or adjusted under 35 U.S.C. 154(b) by 0 days.

(21) Appl. No.: 16/933,200

(22) Filed: Jul. 20, 2020

(65) Prior Publication Data

US 2021/0028579 A1 Jan. 28, 2021

(30) Foreign Application Priority Data

Jul. 22, 2019 (TW) ..... 108125849

(51) Int. Cl.
*H01R 12/70* (2011.01)
*H01R 13/642* (2006.01)
*H01R 12/72* (2011.01)

(52) U.S. Cl.
CPC ..... *H01R 13/642* (2013.01); *H01R 12/7047* (2013.01); *H01R 12/727* (2013.01)

(58) Field of Classification Search
CPC .... H01R 12/722; H01R 12/728; H01R 12/70; H01R 12/71; H01R 12/73; H01R 12/7082; H05K 1/141; H05K 2201/10606; H05K 3/366
See application file for complete search history.

(56) References Cited

U.S. PATENT DOCUMENTS 5,277,611 A * 1/1994 Berek ..... H01R 12/7005 439/325
8,951,070 B1 * 2/2015 Goodwin ..... H01R 12/721 439/660
9,300,065 B2 * 3/2016 Yuan ..... H01R 12/732

* cited by examiner

*Primary Examiner* — Vanessa Girardi
(74) *Attorney, Agent, or Firm* — Rosenberg, Klein & Lee

(57) ABSTRACT

An interface card is provided with an oblique-insert-proof structure. The interface card has an inserting portion configured to be inserted into a slot of a motherboard. The oblique-insert-proof structure is configured to abut the slot. The oblique-insert-proof structure has a connecting portion and two end blocking portions. The connecting portion has a groove in an inserting direction and extending in a length direction. The end blocking portions are configured to abut two shorter side surfaces of the slot. The oblique-insert-proof structure is securely mounted on the interface card and the inserting portion is mounted through the groove. When the interface card is mounted on the motherboard, the oblique-insert-proof structure can assist in aligning the inserting portion with the slot. Also, the oblique-insert-proof structure can enhance the strength of the connection between the interface card and the motherboard, so the interface card can be disposed with more components and bear more weight.

5 Claims, 11 Drawing Sheets

OBLIQUE-INSERT-PROOF STRUCTURE AND INTERFACE CARD COMPRISING THE SAME

BACKGROUND OF THE INVENTION

1. Field of the Invention

The present invention relates to a connecting and fixing structure between electrical devices, especially to a connecting and fixing structure that is utilized in buses of an interface card.

2. Description of the Prior Arts

A host of a computer must be connected to other hardware devices via an interface card for transmitting and processing signals, so that the host and the hardware devices may work. Though a motherboard in the host may comprise basic interface cards, a user who wants to connect a specific device with the host or who needs higher performances may install an extra interface card or expansion card that is configured to connect the host with a specific device or a high performance device. Conventionally, the interface card comprises buses to connect with the motherboard and thereby enhance a signal-transmitting capacity.

For example, as shown in FIG. 10 and FIG. 11, the conventional interface card may comprise an inserting portion 91 for being inserted into a slot 92 of the motherboard and thereby the interface card and the motherboard are connected to each other. The inserting portion 91 may include a Peripheral Component Interconnect bus which comprises multiple gold fingers. Correspondingly, the slot 92 may comprise multiple pins to connect the gold fingers respectively and transmit signals. However, during mounting of the interface card on the motherboard, the inserting portion 91 may not rightly face toward the slot 92. If the inserting portion 91 is inserted into the slot 92, the gold fingers of the inserting portion 91 will not tightly contact the pins, which causes discontinuous transmission of signals and damage to the gold fingers or the entire inserting portion 91. On the other hand, with improvements in power and performance of current components, the entire device may generate heaver vibration, which deteriorates signal transmission.

To overcome the shortcomings, the present invention provides an oblique-insert-proof structure and an interface card to mitigate or obviate the aforementioned problems.

SUMMARY OF THE INVENTION

The main objective of the present invention is to provide an oblique-insert-proof structure and an interface card that can assist in aligning the inserting portion of the interface card with the slot of the motherboard easily.

The oblique-insert-proof structure is configured to abut a slot of a motherboard; an outer surface of the slot includes two longer side surfaces and two shorter side surfaces. The oblique-insert-proof structure has a connecting portion and two end blocking portions. The connecting portion comprises a length direction, a width direction, and an inserting direction perpendicular to one another. The connecting portion also comprises at least one groove. The at least one groove is formed through the connecting portion in the inserting direction and extends in the length direction. The two end blocking portions are securely mounted on two ends of the connecting portion in the length direction respectively, and a distance between the two end blocking portions is equal to a distance between the two shorter side surfaces of the slot, and thereby the two end blocking portions are configured to abut the two shorter side surfaces respectively.

The interface card is configured to be securely mounted in a slot of a motherboard. The interface card has a circuit board, an aforesaid oblique-insert-proof structure, and a first accommodating space. The circuit board has a main body and at least one inserting portion. The at least one inserting portion is configured to be inserted into and is securely mounted in the slot. The oblique-insert-proof structure is securely mounted on the circuit board, and the at least one inserting portion is mounted through the at least one groove of the oblique-insert-proof structure. The oblique-insert-proof structure comprises a first accommodating space. The first accommodating space is formed between each one of the two end blocking portions and the at least one inserting portion. The first accommodating space is configured to guide the slot and receive a side wall of the slot when the at least one inserting portion is mounted in the slot.

When the interface card is mounted on the motherboard, the oblique-insert-proof structure can assist in aligning the inserting portion of the interface card with the slot of the motherboard. Precisely, when mounting the interface card, the two end blocking portions are utilized to abut or clamp the two shorter side surfaces of the slot and thereby the interface card can be aligned accurately to the slot and will not incline with respect to the length direction. Also, the oblique-insert-proof structure can enhance the strength of the connection between the interface card and the motherboard, so the interface card can be disposed with more components and bear more weight.

Other objectives, advantages and novel features of the invention will become more apparent from the following detailed description when taken in conjunction with the accompanying drawings.

DETAILED DESCRIPTION OF THE PREFERRED EMBODIMENTS

Figure 1:
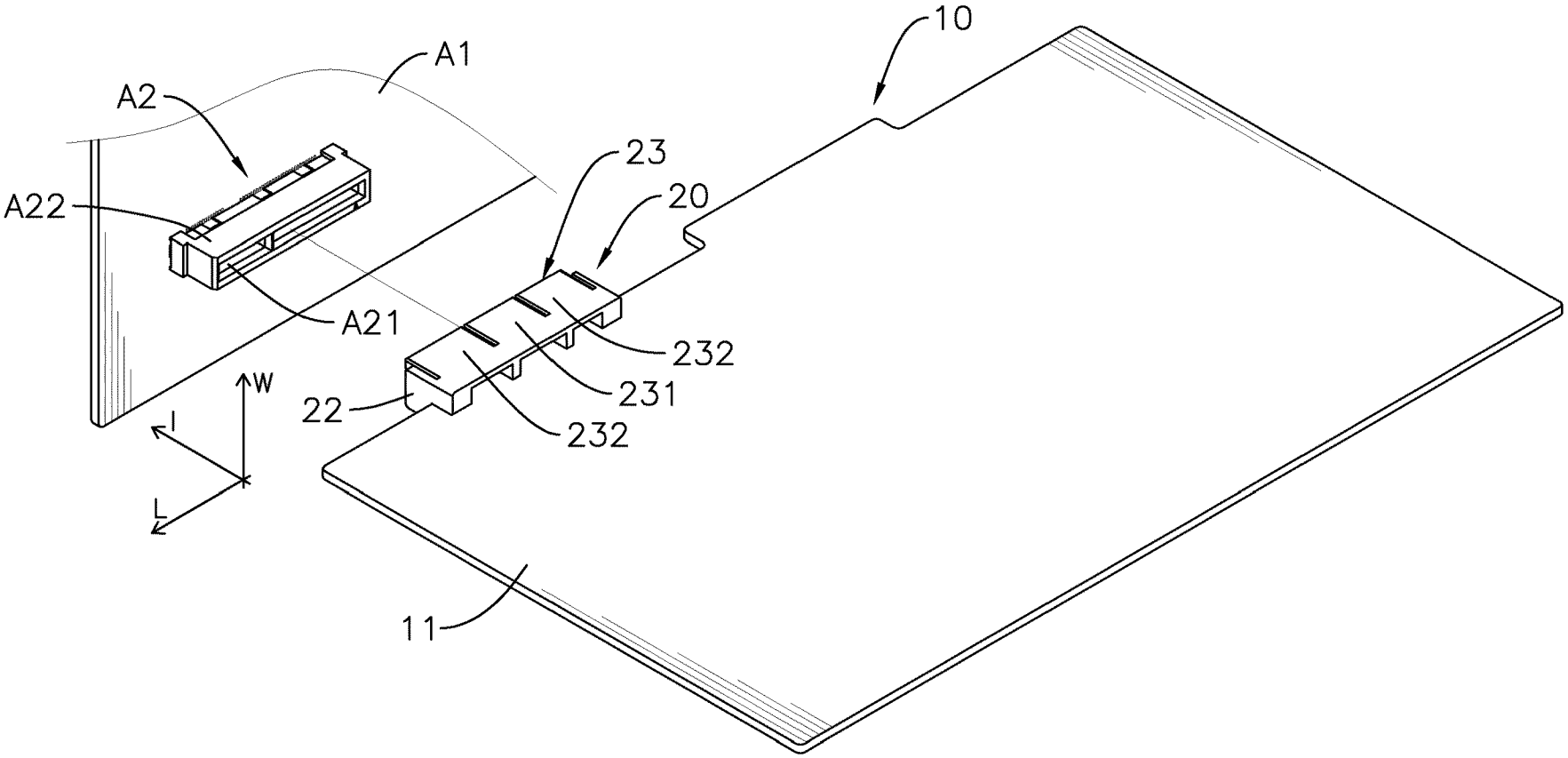
FIG. 1 is a perspective view of an interface card in accordance with the present invention, showing the interface card aligned with a slot of a motherboard.

With reference to FIG. 1 to FIG. 4, an interface card in accordance with the present invention is provided. The interface card is configured to be securely mounted on a slot A2 of a motherboard A1 and thereby electrically connected to the motherboard A1 so as to transmit signals therebetween. An outer surface of the slot A2 comprises two longer side surfaces and two shorter side surfaces.

The interface card comprises a circuit board 10 and an oblique-insert-proof structure 20. The circuit board 10 comprises a main body 11 and at least one inserting portion 12. The inserting portion 12 is configured to be inserted and then securely mounted in the slot A2 of the motherboard A1. In this embodiment, the inserting portion 12 and the slot A2 are made in accordance with Peripheral Component Interconnect standards, but it is not limited thereto. In other words, the inserting portion 12 and the slot A2 may be made in accordance with other transmitting standards. In this embodiment, the interface card comprises two inserting portions 12 for insertion into two receiving spaces A21 of the slot A2 for being connected.

Figure 5:
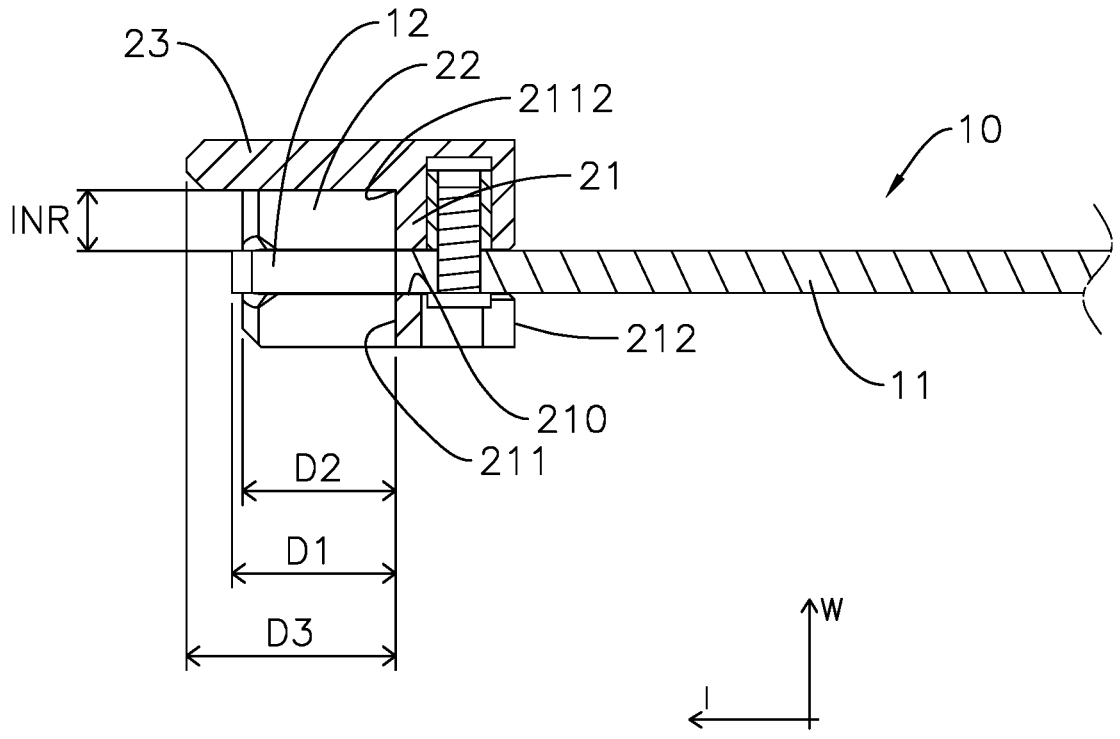
FIG. 5 is a sectional view of the interface card and the oblique-insert-proof structure in FIG. 3.
Figure 6:
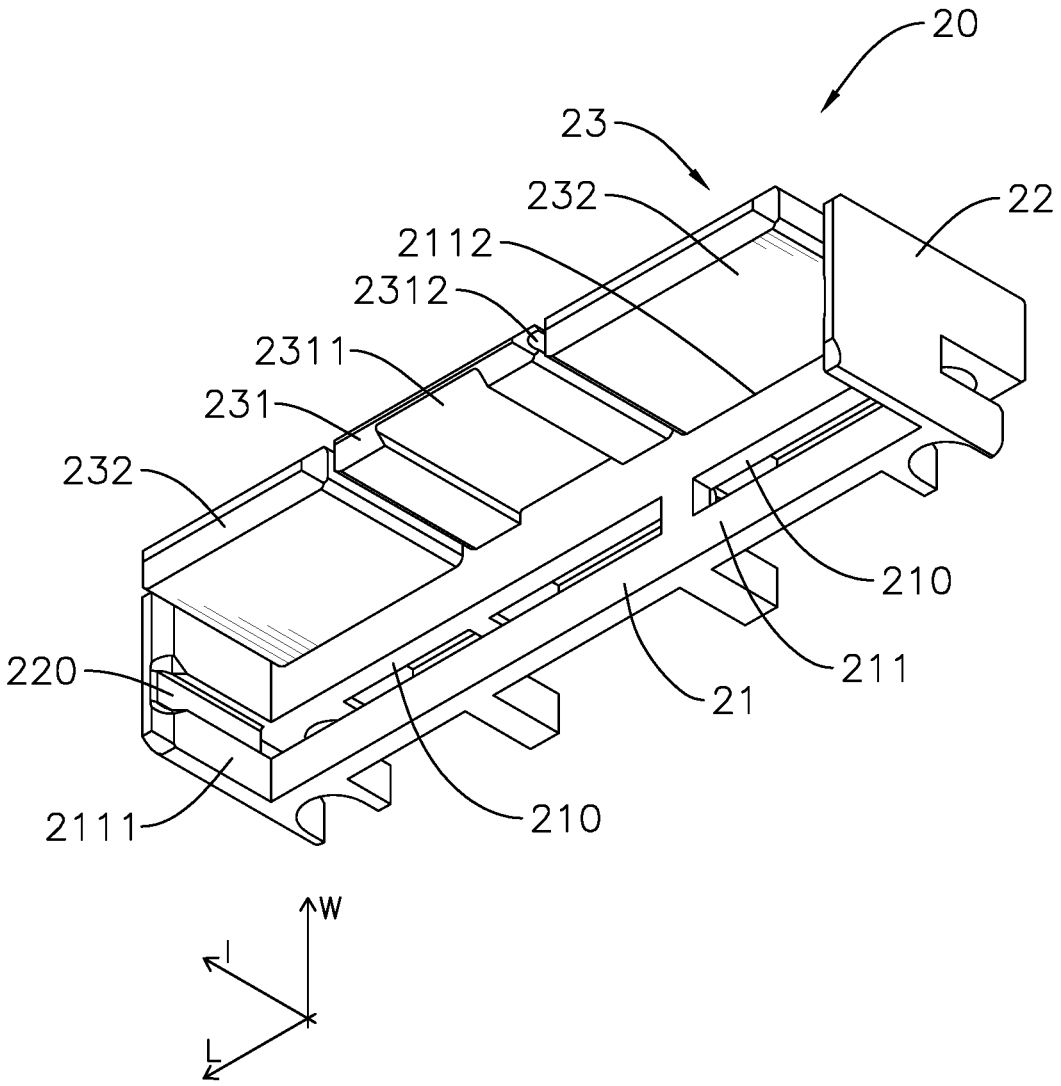
FIG. 6 is a perspective view of the oblique-insert-proof structure in FIG. 3.
Figure 7:
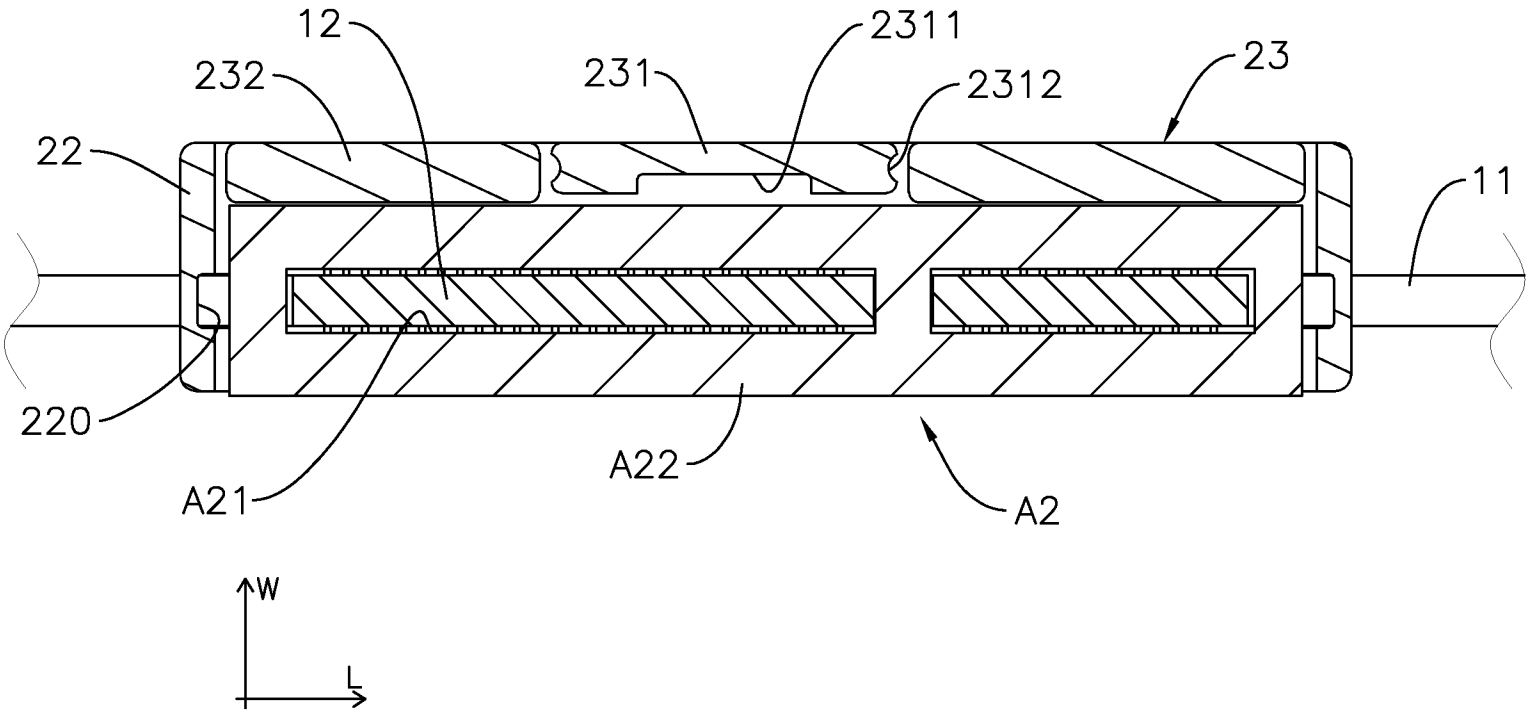
FIG. 7 is a sectional view of the interface card in FIG. 3, showing the interface card inserted in the slot of the motherboard.

Then please refer to FIG. 5 to FIG. 7. The oblique-insert-proof structure 20 is securely mounted on the circuit board 10 and comprises a connecting portion 21 and two end blocking portions 22, and may selectively comprise at least one side blocking portion 23. The connecting portion 21 includes a baseboard and the baseboard has a first lateral surface 211 and a second lateral surface 212. The first lateral surface 211 has two shorter side edges 2111 and at least one longer side edge 2112. The connecting portion 21 may define a length direction L, a width direction W, and an inserting direction I perpendicular to one another. The length direction L is parallel with the longer side edge 2112 of the connecting portion 21 and an extending direction of the receiving space A21 of the slot A2. The width direction W is parallel with the shorter side edge 2111 of the connecting portion 21. The inserting direction I is formed from the second lateral surface 212 to the first lateral surface 211 and is parallel with a moving direction of the inserting portion 12 when being mounted through the oblique-insert-proof structure 20. The connecting portion 21 forms at least one groove 210. The at least one groove 210 extends in the length direction L and is formed through the connecting portion 21 in the inserting direction I. In other words, the at least one groove 210 is penetrated through the baseboard along the inserting direction I. In this embodiment, corresponding to the two inserting portions 12, the connecting portion 21 forms two grooves 210, so that the two inserting portions 12 are mounted through the two grooves 210 respectively. In other words, the inserting portions 12 of the circuit board 10 penetrate through the grooves 210 such that an interval INR is formed between the circuit board 10 and the longer side edge 2112. In another embodiment, the connecting portion 21 may have only one groove 210 and thus the two inserting portions 12 are mounted through the same groove 210. However, it is not limited thereto.

The two end blocking portions 22 are configured to abut the two shorter side surfaces of the slot A2 respectively. Precisely, a distance between the two end blocking portions 22 is equal to a length of the longer side of the slot A2, and a width of a first accommodating space formed between each one of the end blocking portions 22 and the inserting portion 12 is equal to a thickness of a wall of the slot A2. Therefore, the first accommodating space is configured to accommodate the wall of the slot A2 or guide the slot A2 when the interface card is inserted into the slot A2. Precisely, during mounting of the interface card in accordance with the present invention, the two end blocking portions 22 are utilized to abut or clamp the two shorter side surfaces of the slot A2 and thereby the interface card can be aligned accurately to the slot A2 and will not incline with respect to the length direction L. On the contrary, if the interface card inclines with respect to the slot A2, the end blocking portions 22 and the slot A2 will interfere with each other and thereby the inserting portion 12 of the interface card cannot be inserted into the slot A2 unless the interface card is tilted to a proper angle.

In this embodiment, the two end blocking portions 22 are securely mounted on two ends of the connecting portion 21 in the length direction L respectively, and extend in the inserting direction I from the two ends of the connecting portion 21. In the inserting direction I, a distance D1 that the inserting portion 12 protrudes out of the connecting portion 21 is larger than a distance D2 that each end blocking portion 22 protrudes out of the connecting portion 21. In other words, compared to the end blocking portion 22, the inserting portion 12 protrudes more with respect to the connecting portion 21. However, it is not limited thereto; the end blocking portions 22 and the inserting portion 12 may be flush with each other, or the end blocking portion 22 protrudes more.

In this embodiment, each one of the end blocking portions 22 may comprise a first recess 220. The first recess 220 is formed on a surface of the end blocking portion 22 and said surface faces toward the other end blocking portion 22. The first recess 220 extends in the inserting direction I. Therefore, after the oblique-insert-proof structure 20 is securely mounted on the circuit board 10, the first recess 220 faces toward the inserting portion 12 and extends parallel with the inserting portion 12.

The at least one side blocking portion 23 is configured to abut one of the longer side surfaces of the slot A2. On an imaginary projection surface with respect to the width direction W and the length direction L, a width of a second accommodating space formed between the side blocking portion 23 and the longer side, closer to the side blocking portion 23, of the slot A2 is equal to the thickness of the wall of the slot A2. Therefore, the second accommodating space is configured to accommodate the wall of the slot A2 or guide the slot A2 when the interface card is inserted into the slot A2. Precisely, when the interface card in accordance with the present invention is mounted, the side blocking portions 23 are utilized to abut or clamp the two longer side surfaces of the slot A2 and thereby the interface card can be aligned accurately to the slot A2 and will not incline with respect to the length direction L. On the contrary, if the interface card inclines with respect to the slot A2, the side blocking portions 12 will interfere with the slot A2 and thereby the inserting portion 12 of the interface card cannot be inserted into the slot A2 unless the interface card is tilted to a proper angle.

In this embodiment, each one of the at least one side blocking portion 23 is securely mounted on the longer side edge 2112 of the connecting portion 21 such that the interval INR is formed between the at least one side blocking portion 23 and the groove 210. Each one of the at least one side blocking portion 23 extends in the inserting direction I from the longer side edge 2112 of the connecting portion 21. In the inserting direction I, a distance D3 that the side blocking portion 23 protrudes out of the connecting portion 21 is larger than the distance D1 that the inserting portion 12 protrudes out of the connecting portion 21. In other words, compared to the inserting portion 12, the side blocking portion 23 protrudes more with respect to the connecting portion 21.

In this embodiment, the oblique-insert-proof structure 20 may comprise three side blocking portions 23 and the three side blocking portions 23 are securely mounted on the same longer side edge 2112 of the connecting portion 21. Two gaps are formed between every two adjacent ones of the side blocking portions 23. However, an amount of the side blocking portion 23 and an arrangement of the side blocking portion 23 are not limited thereto, and thus the multiple side blocking portions 23 may be mounted on the different longer side edges 2112, which champ the slot A2 when the interface card is inserted in the slot A2. In this embodiment, the side blocking portion 23 at a middle of the three side blocking portions 23 is defined as a middle side blocking portion 231 and the remaining side blocking portions 23 are defined as lateral side blocking portions 232.

The middle side blocking portion 231 may selectively comprise a second recess 2311 and two third recesses 2312. The second recess 2311 is formed on a surface of the middle side blocking portion 231 and said surface is close to the groove 210. The two third recesses 2312 are respectively formed on two surfaces of the middle side blocking portion 231 and said two surfaces respectively face toward the other two side blocking portions 23 (i.e. the lateral side blocking portions 232). The second recess 2311 and the two third recesses 2312 extend in the inserting direction I. In another embodiment, the middle side blocking portion 231 may only comprise the second recess 2311, the third recesses 2312, or an amount of the third recesses 2312 may be one or more than two. In another embodiment, the third recesses 2312 may be formed on surfaces, facing toward the middle side blocking portion 231, of the lateral side blocking portions 232.

With the aforesaid structures, when the interface card is mounted on the motherboard A1, the oblique-insert-proof structure 20 can assist in aligning the inserting portion 12 of the interface card with the slot A2 of the motherboard A1. Also, the oblique-insert-proof structure 20 can enhance the strength of the connection between the interface card and the motherboard A1, so the interface card can be disposed with more components and bear more weight.

Figure 2:
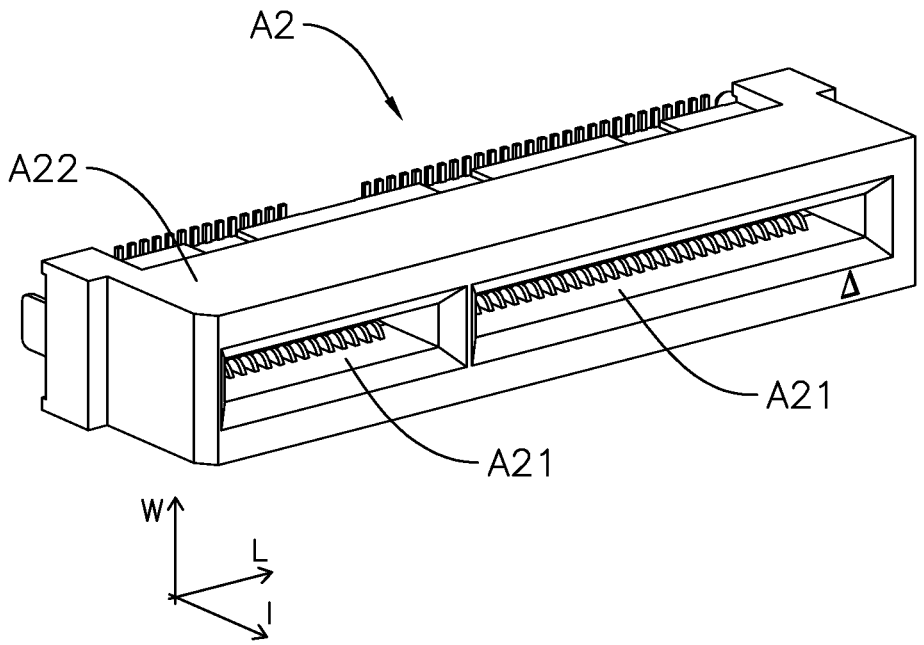
FIG. 2 is a perspective view of the slot of the motherboard in FIG. 1.
Figure 3:
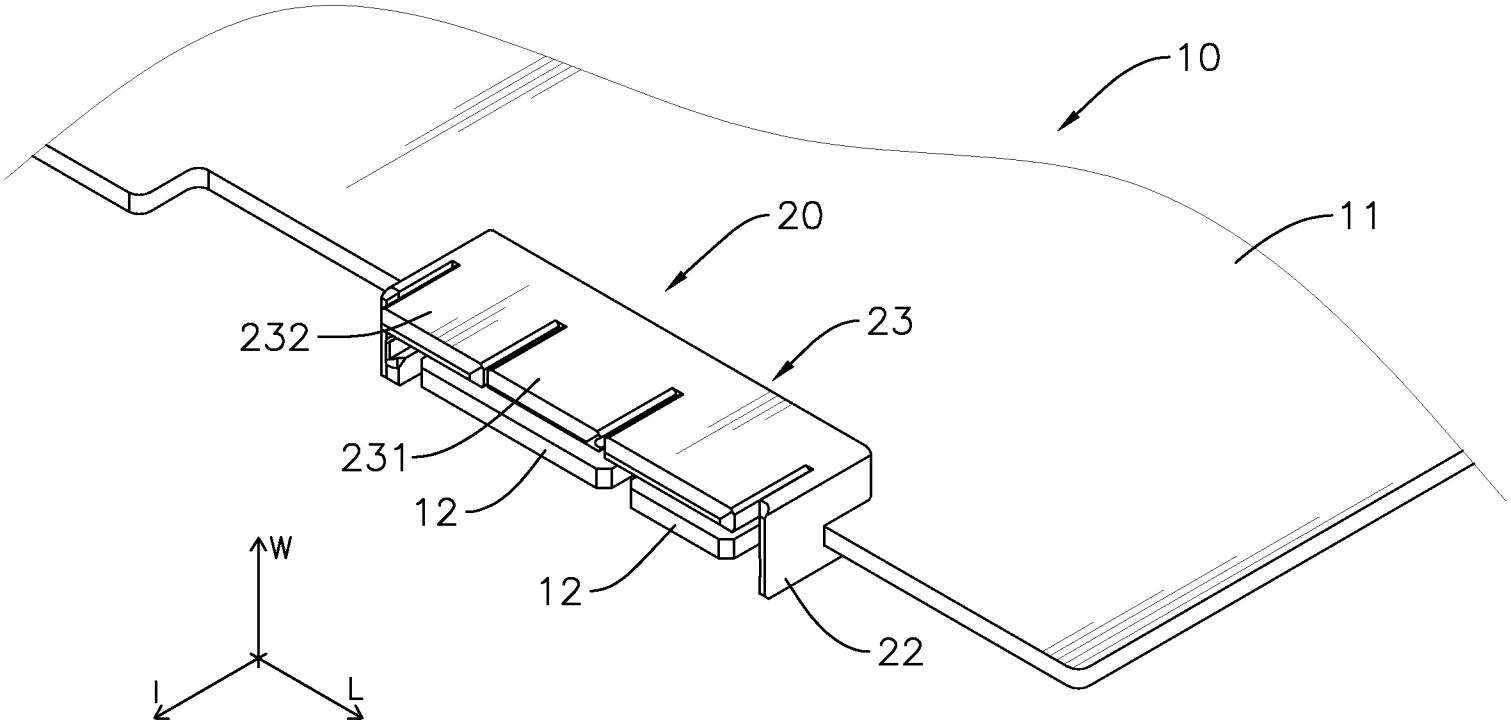
FIG. 3 is a perspective view of the interface card and an oblique-insert-proof structure of the interface card in FIG. 1.
Figure 4:
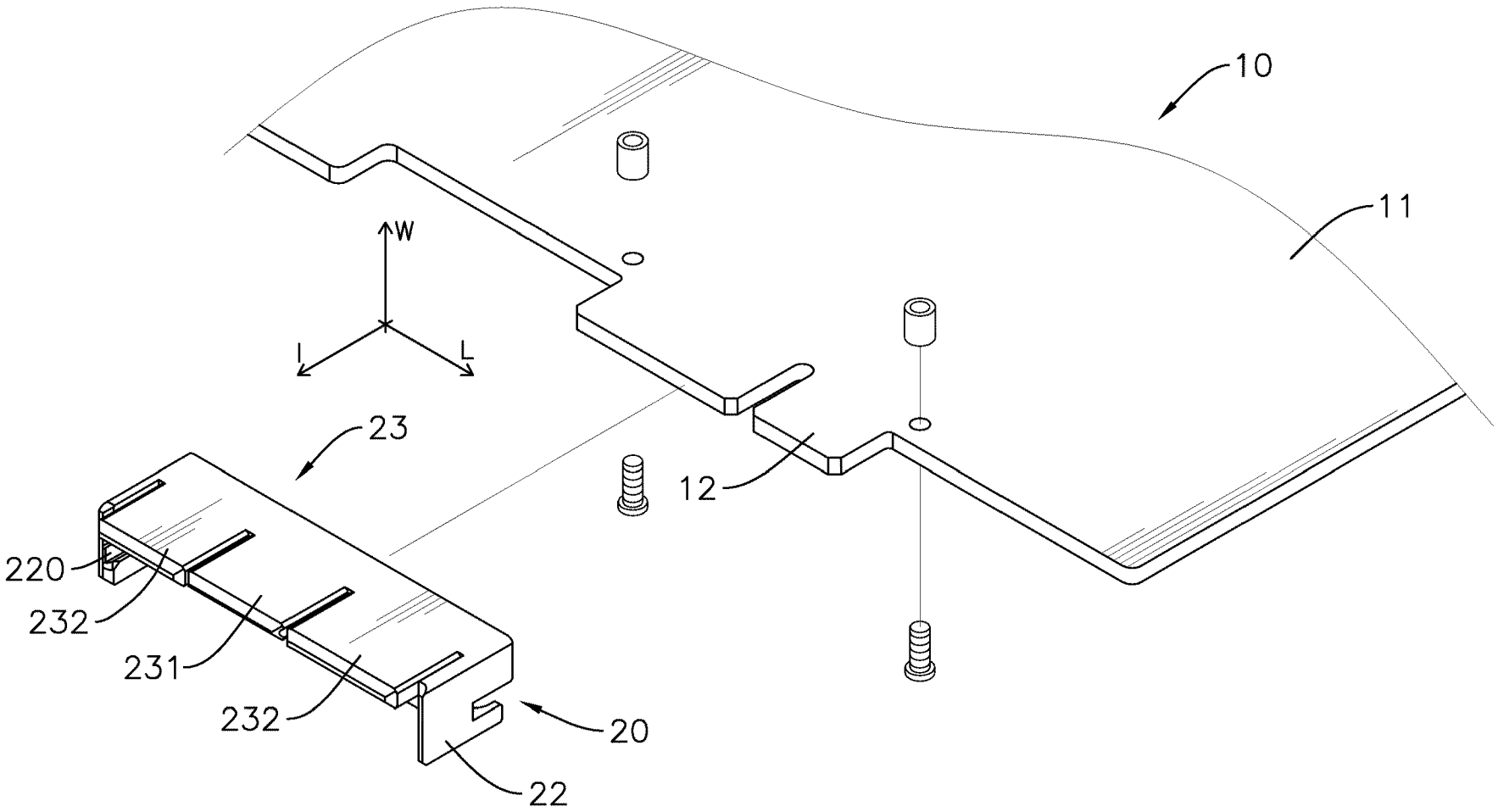
FIG. 4 is an exploded view of the interface card and the oblique-insert-proof structure in FIG. 3.
Figure 8:
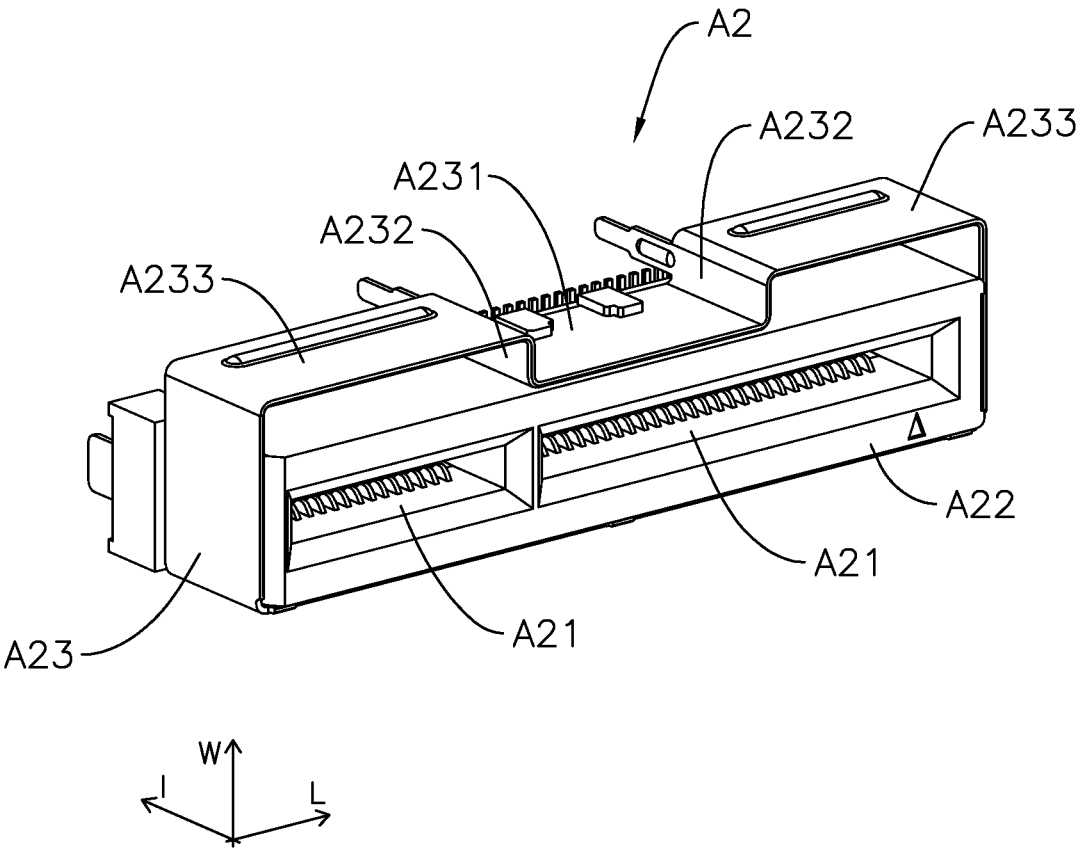
FIG. 8 is a perspective view of the slot in another configuration.

Then please refer to FIG. 2 and FIG. 8. Conventionally, slots are classified into two types. One type of the slot A2 only comprises a stand A22 forming aforesaid receiving space A21 and aforesaid wall. The other type of slot A2 further comprises a protecting shell A23 mounted on the stand A22. Normally, the protecting shell A23 encloses the stand A22, and the protecting shell A23 comprises a closing section A231, two separating sections A232, and two remote sections A233. The closing section A231 contacts the stand A22. The two separating sections A232 are respectively connected to two ends of the closing section A231 and are perpendicular to an outer surface of the stand A22. Each one of the remote sections A233 is connected to a side, away from the closing section A231, of a respective one of the separating sections A232 and is parallel with the outer surface of the stand A22. In other words, a clamping space is formed between each remote section A233 and the stand A22.

Figure 9:
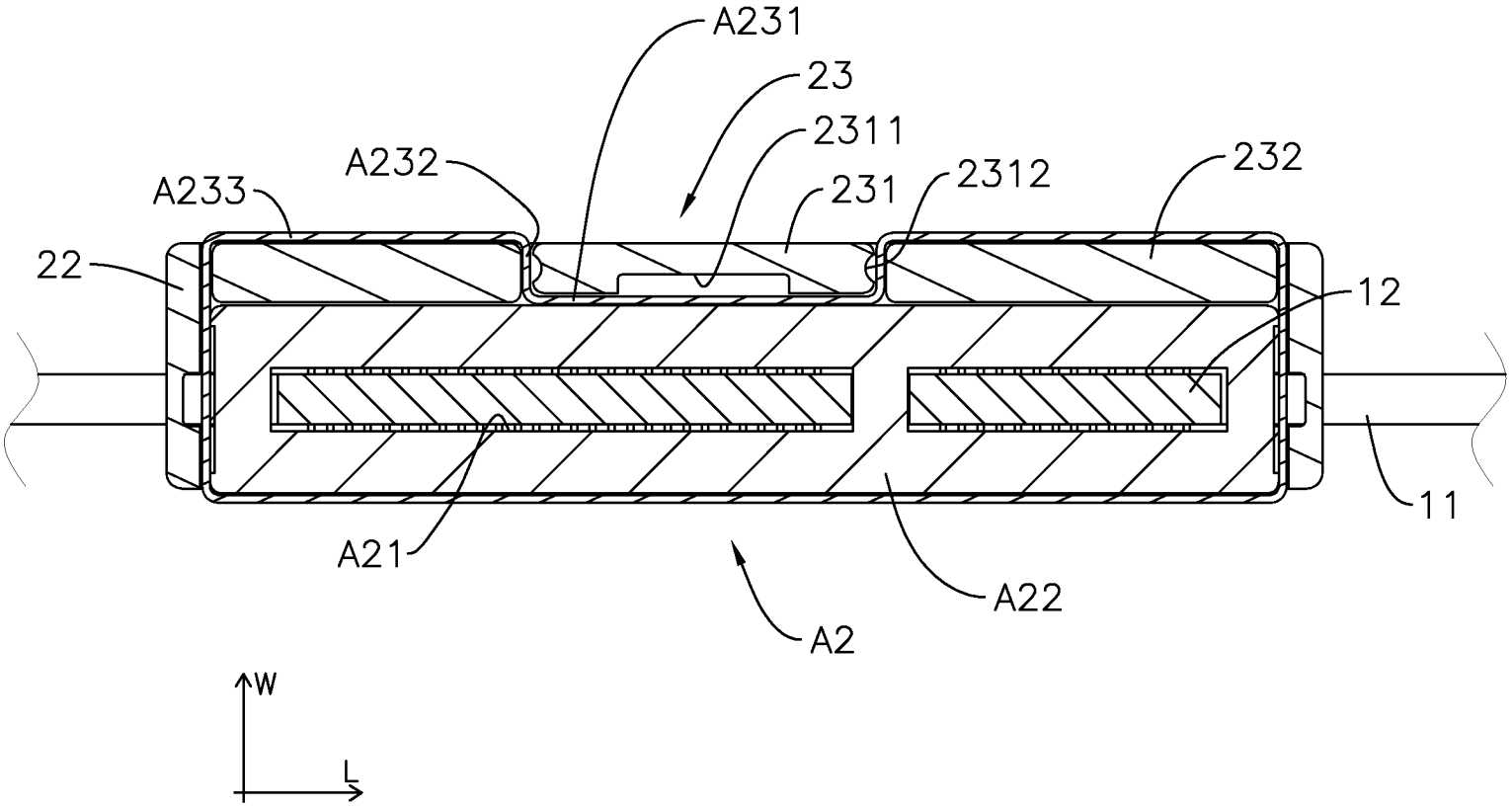
FIG. 9 is a sectional view of the interface card in FIG. 3, showing the interface card inserted in the slot in another configuration.
Figure 10:
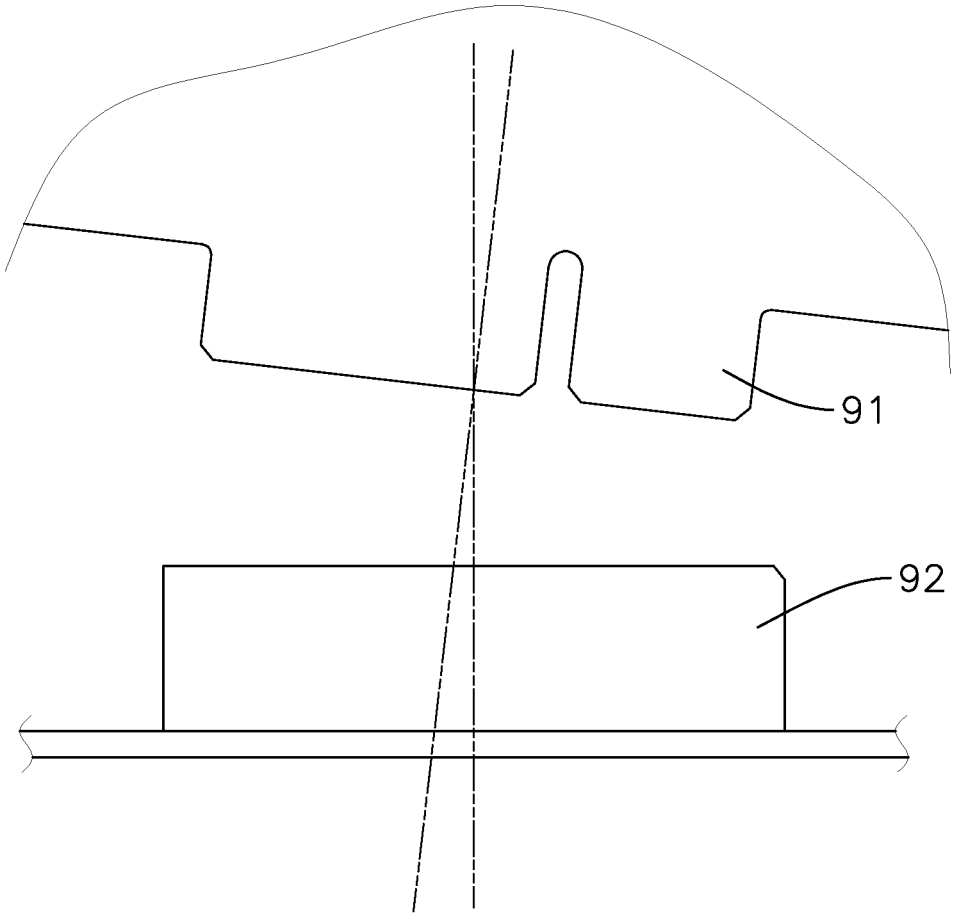
PRIOR ART FIG.10
FIG. 10 and FIG. 11 are perspective views of prior art, showing the interface card inserted into the slot of the motherboard in an oblique direction.
Figure 11:
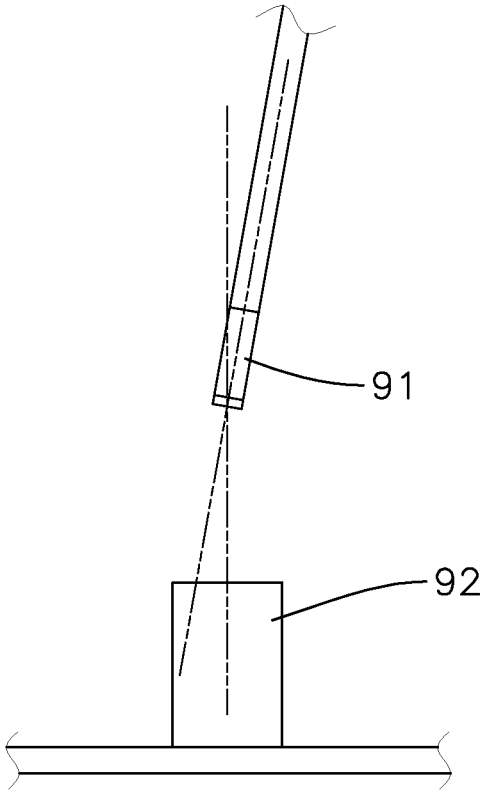
PRIOR ART FIG.11

Then please refer to FIG. 9. After the interface card is inserted into the slot A2, the two separating sections A232 are respectively mounted through the two gaps between the side blocking portions 23. In other words, the middle side blocking portion 231 is clamped between the two separating sections A232 and each lateral side blocking portion 232 is clamped between a respective one of the remote sections A233 and the stand A22, i.e. in the clamping space.

Even though numerous characteristics and advantages of the present invention have been set forth in the foregoing description, together with details of the structure and features of the invention, the disclosure is illustrative only. Changes may be made in the details, especially in matters of shape, size, and arrangement of parts within the principles of the invention to the full extent indicated by the broad general meaning of the terms in which the appended claims are expressed.

What is claimed is:

1. An oblique-insert-proof structure comprising:

a connecting portion, having a baseboard, the baseboard having a first lateral surface and a second lateral surface, the first lateral surface having two shorter side edges and at least one longer side edge, the baseboard having at least one groove, the at least one groove penetrated through the baseboard along an inserting direction from the second lateral surface to the first lateral surface;

at least two end blocking portions, one of the end blocking portions being located at one of the two shorter side edges on the first lateral surface, and another of the at least two end blocking portions being located at the other shorter side edge on the first lateral surface, the at least two end blocking portions extending along the inserting direction from the first lateral surface respectively;

at least three side blocking portions, the at least three side blocking portions being disposed at the longer side edge on the first lateral surface between the two end blocking portions, each of the at least three side blocking portions extending along the inserting direction from the first lateral surface respectively, an interval formed between the at least three side blocking portions and the at least one groove, at least two gaps being formed between the at least three side blocking portions, each of the two gaps being formed between two of the adjacent side blocking portions so as to allow an external object to be inserted therein along an opposite direction to the inserting direction respectively, a distance that the at least three side blocking portions protrude out of the connecting portion being larger than a distance that the at least two end blocking portions protrude out of the connecting portion.

2. The oblique-insert-proof structure as claimed in claim 1, wherein each of the end blocking portions comprises a first recess facing toward the another one of the at least two end blocking portions, the first recess extending along the inserting direction.

3. An interface card, configured to be securely mounted in a slot of a motherboard, the interface card comprising:

a circuit board; and the oblique-insert-proof structure as claimed in claim 1 securely mounted with the circuit board, and at least part of the circuit board penetrating through the at least one groove of the oblique-insert-proof structure, the interval of the oblique-insert-proof structure located between the circuit board and the at least three side blocking portions.

4. The oblique-insert-proof structure as claimed in claim 1, wherein the side blocking portion located between the other two side blocking portions being a middle side blocking portion, the middle side blocking portion comprises a second recess formed on a surface thereof, the second recess formed on a surface of the middle side blocking portion and extending along the inserting direction, the surface of the middle side blocking portion facing toward the groove of the side blocking portion.

5. The oblique-insert-proof structure as claimed in claim 4, wherein the middle side blocking portion comprises a plurality of third recesses, the plurality of third recesses are formed on two different lateral surfaces of the middle side blocking portion and facing toward the other side blocking portions.

* * * * *